US010259242B2

(12) United States Patent
Nakada

(10) Patent No.: US 10,259,242 B2
(45) Date of Patent: Apr. 16, 2019

(54) MEDIA SUPPLYING APPARATUS AND IMAGE FORMING APPARATUS

(71) Applicant: Kikuya Nakada, Kanagawa (JP)

(72) Inventor: Kikuya Nakada, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 213 days.

(21) Appl. No.: 15/521,636

(22) PCT Filed: Jan. 6, 2016

(86) PCT No.: PCT/JP2016/000040
§ 371 (c)(1),
(2) Date: Apr. 25, 2017

(87) PCT Pub. No.: WO2016/111247
PCT Pub. Date: Jul. 14, 2016

(65) Prior Publication Data

US 2017/0246889 A1 Aug. 31, 2017

(30) Foreign Application Priority Data

Jan. 9, 2015 (JP) ..... 2015-002988

(51) Int. Cl.
*B41J 15/16* (2006.01)
*B65H 19/10* (2006.01)
(Continued)

(52) U.S. Cl.
CPC ..... *B41J 15/16* (2013.01); *B41J 11/0045* (2013.01); *B65H 19/10* (2013.01); *B65H 23/04* (2013.01);
(Continued)

(58) Field of Classification Search
CPC ..... B41J 15/16; B41J 11/0045; B65H 23/04; B65H 23/28; B65H 19/10
See application file for complete search history.

(56) References Cited

U.S. PATENT DOCUMENTS 5,393,151 A 2/1995 Martin et al.
5,951,181 A 9/1999 Hierro et al.
(Continued)

FOREIGN PATENT DOCUMENTS

JP H05-051156 3/1993
JP H11-011750 1/1999
(Continued)

OTHER PUBLICATIONS

European search report dated Sep. 20, 2017 in connection with corresponding European patent application No. 16734988.5.
(Continued)

*Primary Examiner* — Sang K Kim
(74) *Attorney, Agent, or Firm* — Cooper & Dunham LLP

(57) ABSTRACT

A medium supplying apparatus with a detachable rolled medium is provided. In the medium supplying apparatus, the rolled medium is fed to a far side of a setting-and-removing direction of the rolled medium. The medium supplying apparatus includes a plurality of guide members configured to guide the rolled medium when the rolled medium is set. The guide members include at least one contact member which at least partially contacts only a lower outer periphery of the rolled medium and at least one auxiliary member which does not contact the outer periphery of the rolled medium. The contact member and the auxiliary member are connected at a base via the same rotary shaft. The auxiliary member is shorter than the contact member in a medium feeding direction, and is disposed in parallel with the contact member.

13 Claims, 7 Drawing Sheets

(51) Int. Cl.

| | |
|---|---|
| ***B65H 23/28*** | (2006.01) |
| ***B41J 11/00*** | (2006.01) |
| ***B65H 23/04*** | (2006.01) |
| *B65H 29/52* | (2006.01) |

(52) U.S. Cl.

CPC ..... *B65H 23/28* (2013.01); *B65H 29/52* (2013.01); *B65H 2301/413* (2013.01); *B65H 2301/4435* (2013.01); *B65H 2301/522* (2013.01); *B65H 2404/691* (2013.01); *B65H 2801/06* (2013.01); *B65H 2801/12* (2013.01); *B65H 2801/15* (2013.01); *B65H 2801/36* (2013.01)

(56) References Cited

U.S. PATENT DOCUMENTS

| | | | | |
|---|---|---|---|---|
| 8,800,909 | B2 | 8/2014 | Morinaga | |
| 9,694,603 | B1 * | 7/2017 | Jariabka | B41J 11/0045 |
| 2006/0001729 | A1 | 1/2006 | Inana | |
| 2006/0157526 | A1 | 7/2006 | Shiraishi et al. | |
| 2016/0121626 | A1 * | 5/2016 | Masunaga | B41J 13/009 347/104 |
| 2016/0136980 | A1 * | 5/2016 | Kobayashi | B41J 15/04 347/104 |
| 2016/0136981 | A1 * | 5/2016 | Suzuki | B41J 15/16 347/104 |

FOREIGN PATENT DOCUMENTS

| | | |
|---|---|---|
| JP | 2000-272794 | 10/2000 |
| JP | 2006-016167 | 1/2006 |
| JP | 2011-105445 | 6/2011 |
| JP | 2011-225320 | 11/2011 |
| JP | 2014-131841 | 7/2014 |

OTHER PUBLICATIONS

International Search Report dated Apr. 5, 2016 in PCT/JP2016/000040 filed on Jan. 6, 2016.

* cited by examiner

[Fig. 1]
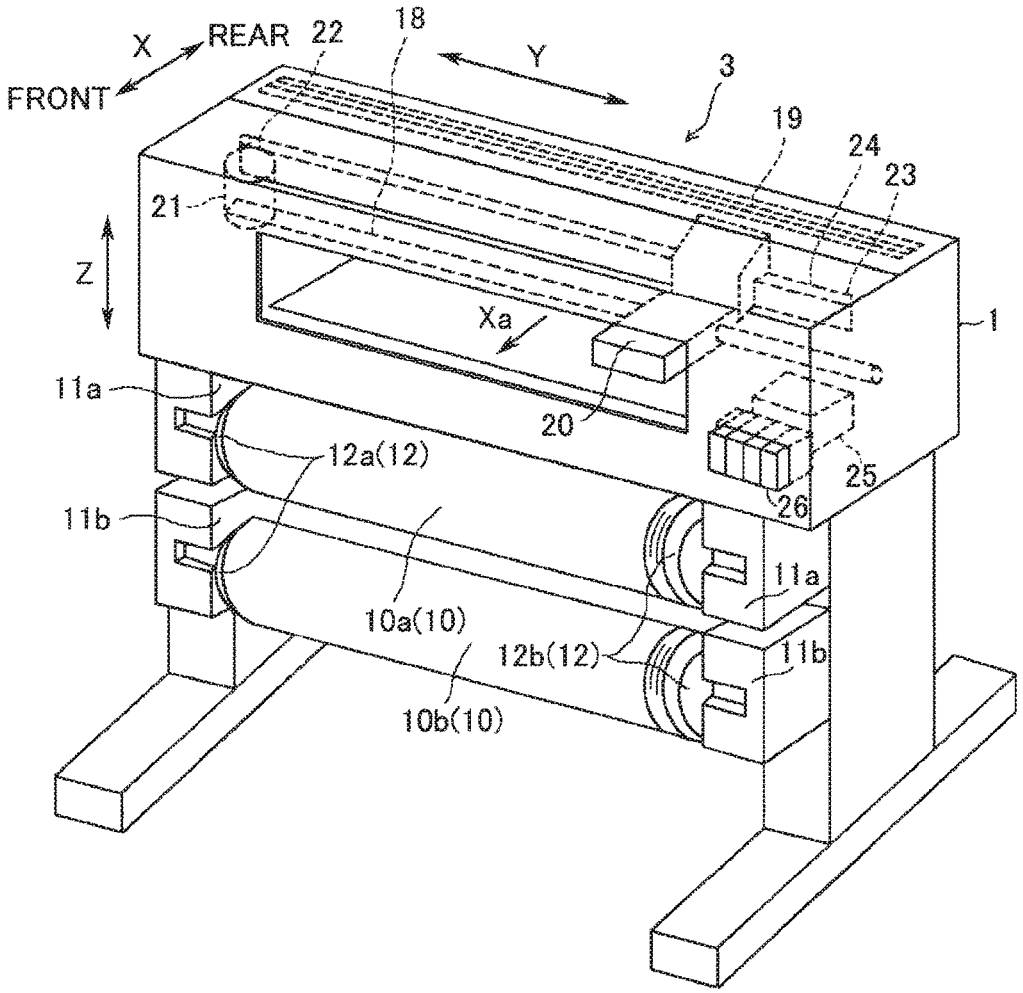

[Fig. 2]
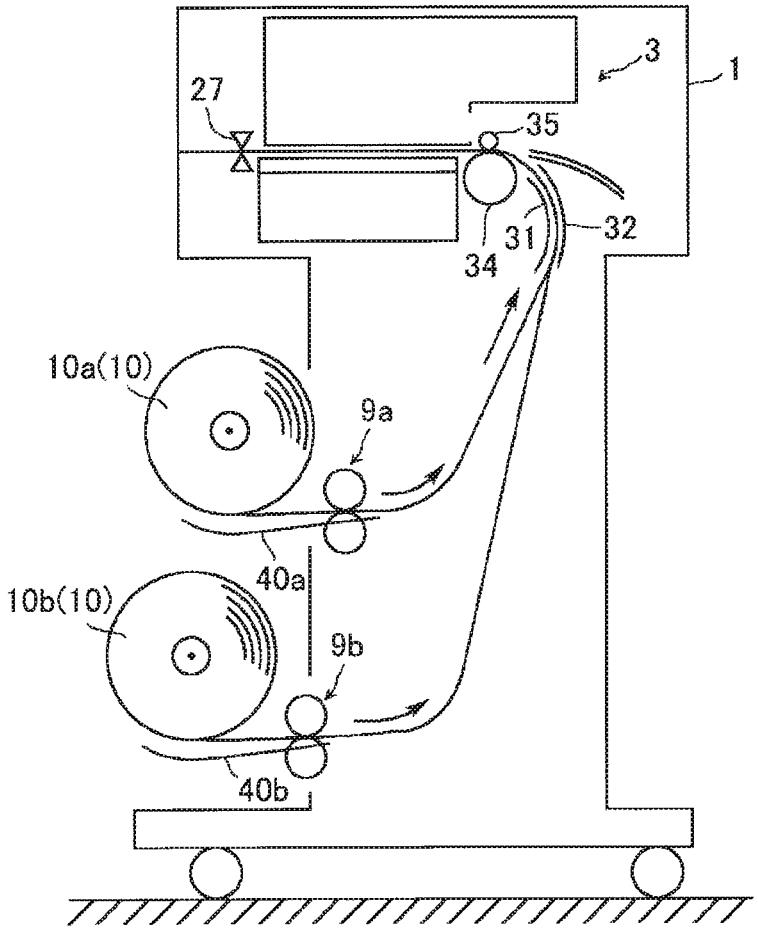

[Fig. 3]
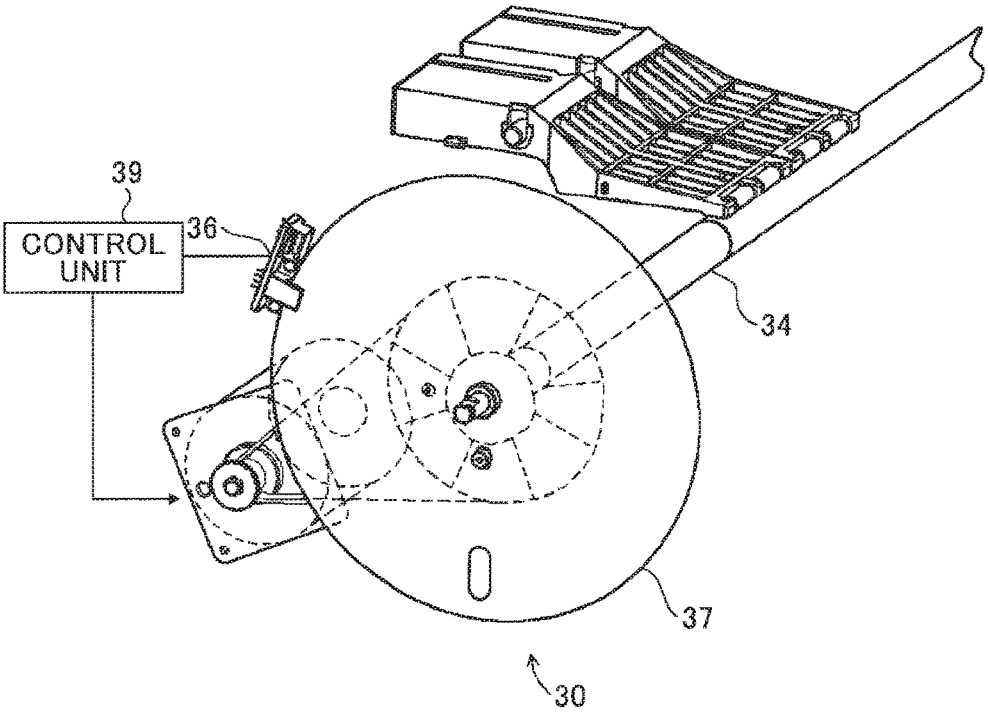
[Fig. 4]
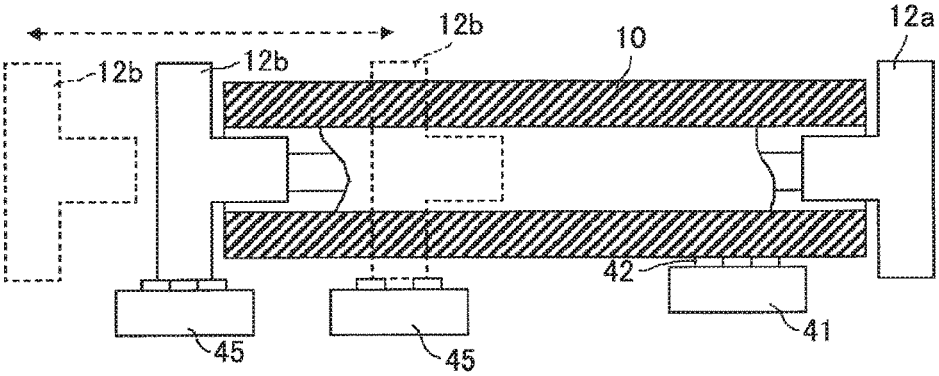

[Fig. 5]
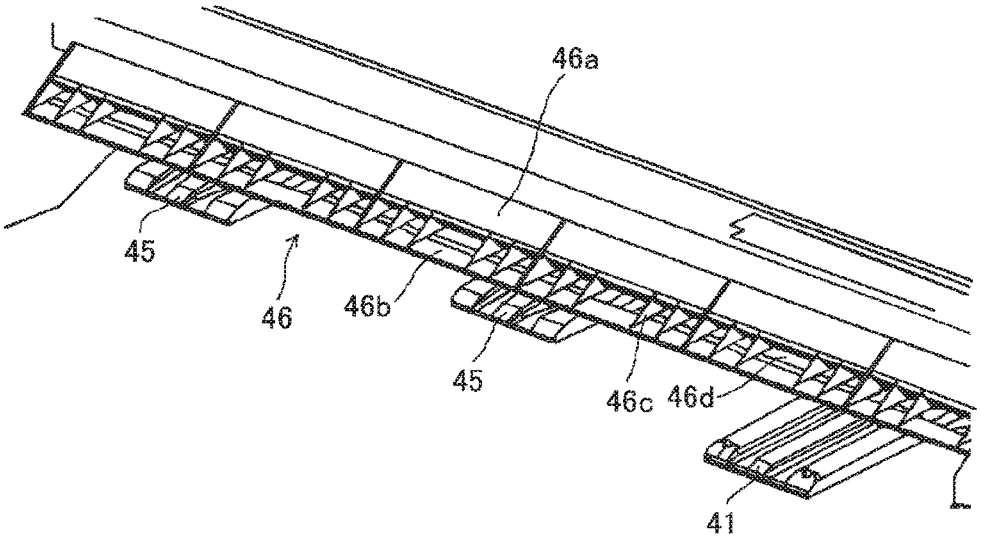
[Fig. 6]
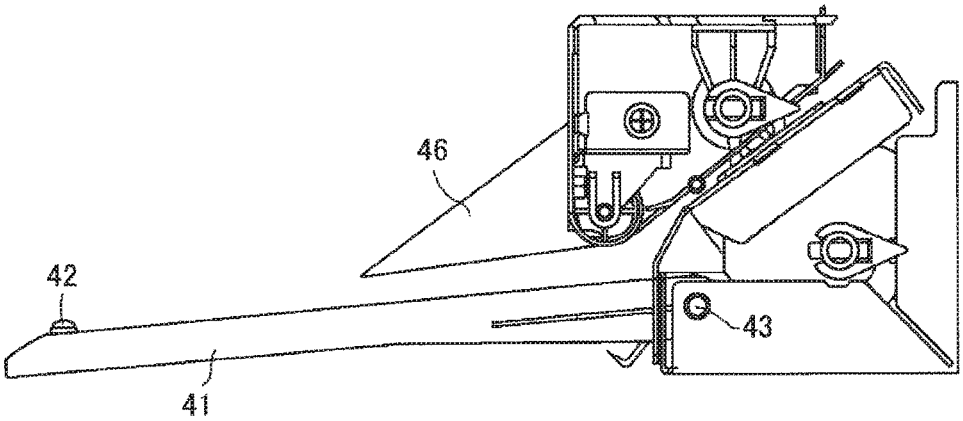

[Fig. 7]
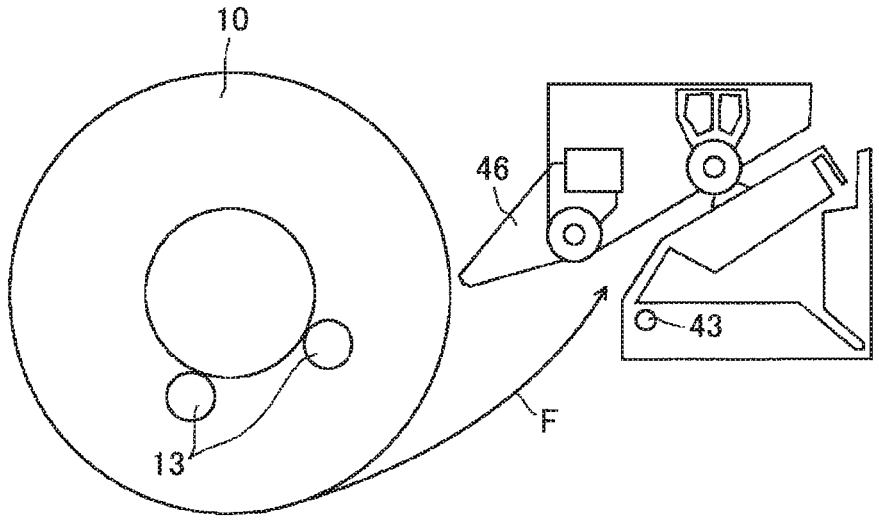
[Fig. 8]
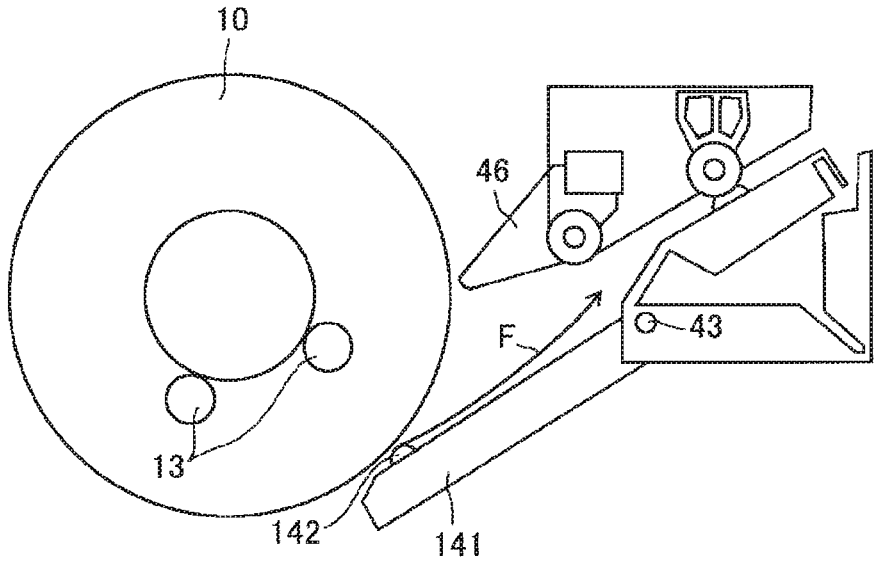

[Fig. 9]
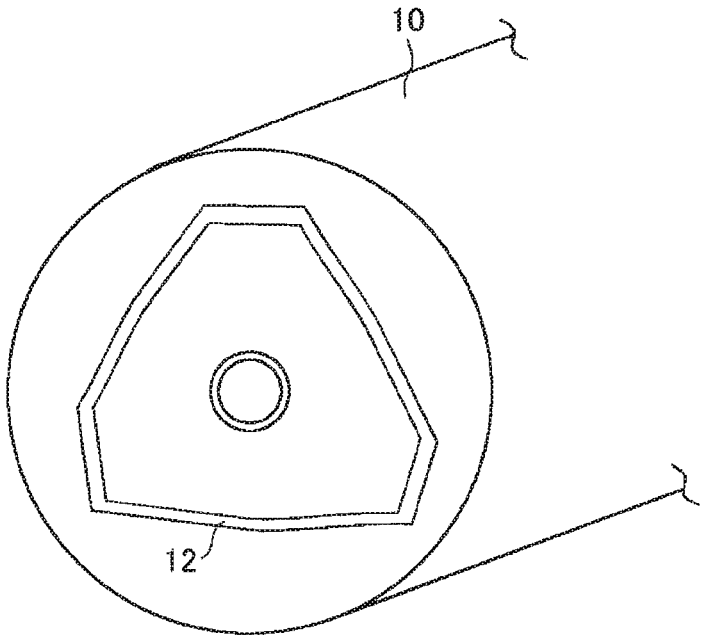
[Fig. 10]
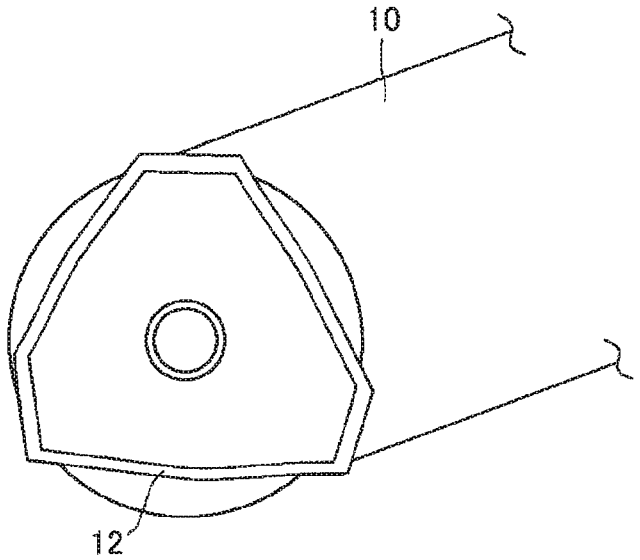

[Fig. 11]
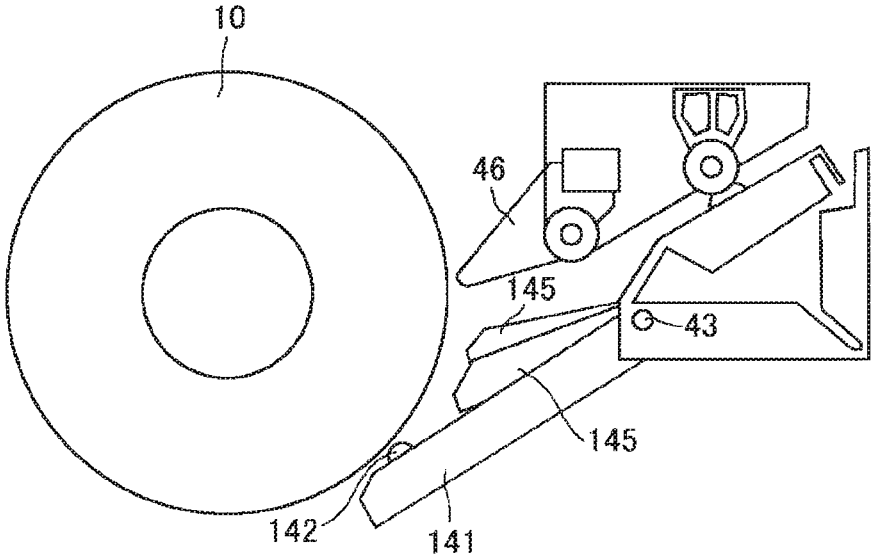
[Fig. 12]
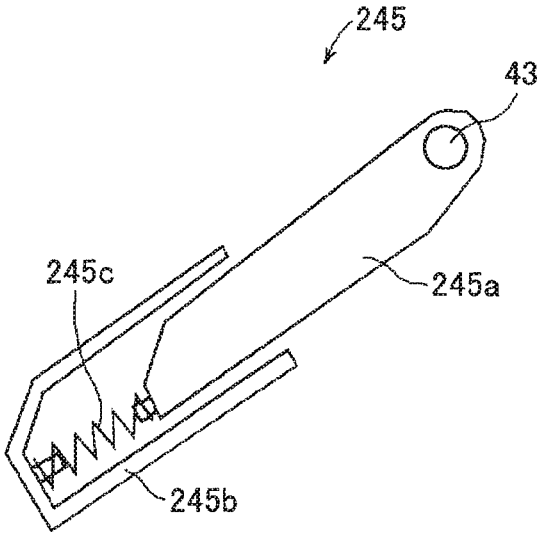

MEDIA SUPPLYING APPARATUS AND IMAGE FORMING APPARATUS

TECHNICAL FIELD

The present invention relates to a rolled medium conveying apparatus which conveys a rolled medium formed of a rolled elongated-paper, and an image forming apparatus which includes the rolled medium conveying apparatus.

BACKGROUND ART

There is an image forming apparatus in which a rolled medium formed of a rolled elongated-paper is used as a recording medium. This kind of image forming apparatus includes a rolled medium supplying apparatus from which the rolled medium is rolled out and supplied. Further, in order to improve operations including exchanging the rolled medium, a setting position, where the rolled medium is set in the rolled medium supplying apparatus, is provided in a front surface of the image forming apparatus.

Further, it is required that the image forming apparatus correspond to multistage rolls and that the height of the image forming apparatus be suppressed. Further, it is required that, in order to reduce an occurrence of slanting conveyance of the medium when conveying the medium, the conveyance route be as short as possible.

In order to meet the above requirements, a method is considered to be optimum in which the rolled medium is disposed under an image printing unit, a conveyance roller is disposed in the far side of the image forming apparatus, and a tip of the rolled medium is set in the far side of the rolled medium supplying apparatus.

However, in the image forming apparatus described above, it is difficult for an operator to set the rolled medium in the rolled medium supplying apparatus because, when the operator sets the rolled medium in the rolled medium supplying apparatus, it is necessary for the operator to insert the tip of the rolled medium into a guide, but the rolled medium itself blocks the view of the operator.

Here, another method can be considered in which, after having the rolled medium set in the rolled medium supplying apparatus, by rotating the rolled medium, the tip of the rolled medium is guided to the guide.

However, because a thick paper and a small amount of remaining rolled medium near a roll core have strong curling and the tip of the rolled medium is affected by the curling, it may become difficult to guide the tip of the rolled medium to the guide.

In order to solve the above problem, a technique is already known in which a guide capable of following an outer periphery of the rolled medium is provided, and, by having the operator rotate the rolled medium, the tip of the rolled medium is separated from the rolled medium and is guided to the conveyance roller (refer to, for example, Patent Document 1).

However, in the paper feeding apparatus according to Patent Document 1, in the case of a small amount of remaining rolled paper or a rolled paper whose end is adhered to a roll-core body, the guide, interfering or contacting the paper being conveyed, becomes a conveyance load, which may lead to a problem of low print quality.

In order to avoid the above problem, it may be considered that the guide be made as short as possible, which then leads to a problem that the visibility of the guide when setting the rolled paper in the paper feeding apparatus is degraded.

SUMMARY OF INVENTION

It is an object of the present invention to provide a rolled medium supplying apparatus which is capable of maintaining print quality and which makes it easy to set the rolled medium in the rolled medium supplying apparatus.

Solution to Problem

In order to achieve the above object, an embodiment of the present invention provides a medium supplying apparatus. The medium supplying apparatus includes a detachable rolled medium and the rolled medium is fed to the far side of a setting-and-removing direction. The medium supplying apparatus includes a plurality of guide members for guiding the rolled medium. The guide members include at least one contact member which at least partially contacts only a lower outer periphery of the rolled medium and at least one auxiliary member which does not contact the outer periphery of the rolled medium. The contact member and the auxiliary member are connected at a base via the same rotary shaft. The auxiliary member is shorter than the contact member in a medium feeding direction, and is disposed in parallel with the contact member.

Advantageous Effects of Invention

According to an embodiment of the present invention, a rolled medium supplying apparatus can be provided which apparatus is capable of maintaining print quality and making it easy to set the rolled medium in the rolled medium supplying apparatus.

BRIEF DESCRIPTION OF DRAWINGS

FIG. 1 is a schematic diagram illustrating an image forming apparatus according to a first embodiment of the present invention.

FIG. 2 is a schematic sectional view illustrating the image forming apparatus shown in FIG. 1.

FIG. 3 is a main section enlarged view of a medium conveyance apparatus of the image forming apparatus shown in FIG. 1.

FIG. 4 is a schematic diagram illustrating a rolled medium setting guide of the image forming apparatus shown in FIG. 1.

FIG. 5 is a perspective view of the rolled medium setting guide of the image forming apparatus shown in FIG. 1.

FIG. 6 is a schematic sectional view illustrating a rolled medium setting guide of the image forming apparatus shown in FIG. 1.

FIG. 7 is a drawing illustrating a conventional method of setting a rolled medium in the image forming apparatus.

FIG. 8 is a drawing illustrating a method of setting a rolled medium in the image forming apparatus shown in FIG. 1.

FIG. 9 is an overview of a roll supporting member and a remaining amount of the rolled medium of the image forming apparatus shown in FIG. 1.

FIG. 10 is an overview of the roll supporting member and the remaining amount of the rolled medium of the image forming apparatus shown in FIG. 1.

FIG. 11 is a layout drawing of a rolled medium setting guide of the image forming apparatus according to a second embodiment of the present invention.

FIG. 12 is a diagram illustrating an extension-and-contraction mechanism of the rolled medium setting guide of the image forming apparatus according to a third embodiment of the present invention.

DESCRIPTION OF EMBODIMENTS

In the following, a first embodiment of the present invention will be described referring to the accompanying drawings.

Configuration of Image Forming Apparatus

As shown in FIG. 1, an image forming apparatus 1 according to the present embodiment is an inkjet printer which performs printing by ejecting ink droplets onto a recording medium according to image data. It should be noted that the present invention can be applied to a copy machine or a printer of an electrophotographic system in which printing is performed by conveying the recording medium.

In FIG. 1, an arrow X indicates a depth direction (front-and-rear direction) of the image forming apparatus 1, an arrow Y indicates a width direction (main-scanning direction) of the image forming apparatus 1, and an arrow Z indicates an up-and-down direction of the image forming apparatus 1.

An image forming unit 3 performs image forming by using an inkjet recording method, and the image forming apparatus 1 according to the present embodiment is a serial type inkjet recording apparatus.

In the image forming unit 3, a guide rod 18 and a guide rail 19 are disposed between side plates, and a carriage 20 which is movable in the main-scanning direction Y is supported by the guide rod 18 and the guide rail 19.

The carriage 20 includes liquid recording heads which eject corresponding ink droplets of black (K), yellow (Y), magenta (M), and cyan (C). Each of the liquid recording heads includes an integral sub tank used for supplying ink.

A main-scanning mechanism for moving the carriage 20 for scanning in the main-scanning direction includes a drive motor 21 disposed at one side of the main-scanning direction Y (upper left in FIG. 1), a drive pulley 22 which is connected to an output axle of the drive motor 21 and driven by the drive motor 21 via the output axle, a follower pulley 23 disposed at the other side of the main-scanning direction Y (lower right in FIG. 1), and a belt member 24 which is rolled around between the drive pulley 22 and the follower pulley 23.

Tension is applied by a tension spring to the follower pulley 23 in an outward direction, that is, in a direction away from the drive pulley 22.

The belt member 24, a part of which is fixed to a belt fixing unit disposed at the rear side of the carriage 20, pulls the carriage 20 in the main-scanning direction.

An encoder sheet is disposed along the main-scanning direction Y of the carriage 20, and an encoder sensor disposed in the carriage 20 reads the encoder sheet and detects a position of the carriage 20 in the main-scanning direction Y.

Further, a reflective sensor included in the carriage 20 detects both ends of the rolled medium 10 set in the image forming apparatus 1. When both ends of the rolled medium 10 are detected, a size of the rolled medium 10 is calculated from the detected positions read by the encoder sensor.

A rolled paper which is formed by rolling an elongated paper, for example, is used as the rolled medium 10, and the rolled medium 10 includes an upper stage rolled medium 10*a* and a lower stage rolled medium 10*b*. The upper stage rolled medium 10*a* and the lower stage rolled medium 10*b* are set in a medium supplying apparatus. The medium supplying apparatus includes roll supporting members 12 which support ends of the upper stage rolled medium 10*a* and the lower stage rolled medium 10*b* in the longitudinal direction. Respective spool axles of the upper stage rolled medium 10*a* and the lower stage rolled medium 10*b* are rotatably supported by spool bearing stands 11*a* and 11*b* via core tubes. The upper stage rolled medium 10*a* and the lower stage rolled medium 10*b* are detachable.

It should be noted that the medium supplying apparatus may include an axial unit which is inserted into the core tube of the rolled medium 10. The axial unit includes a flexible diameter-increasing member in order to correspond to core tubes with different diameters. Further, a rolled medium 10 with a large-diameter core tube is supported by the axial unit with the diameter-increasing member, and a rolled medium 10 with a small-diameter core tube is supported by the axial unit from which the diameter-increasing member is separated.

The rolled medium 10 is rolled out by the medium supplying apparatus, and is conveyed to the far side in the setting-and-removing direction. Further, the medium is conveyed discontinuously in a sub-scanning direction (front direction Xa of the front-and-rear direction X in FIG. 1) orthogonal to the main-scanning direction Y which is a moving direction of the carriage 20 as shown in FIG. 3. An encoder sheet 37 which is disposed on and rotates around the axis of a registration roller (alignment roller) 34 is read by an encoder sensor 36 which is disposed on one of the side plates. Further, based on the read information, the rolled medium 10 is controlled by a control unit 39.

In one end side of a main scanning area of the carriage 20, as shown in the lower right side of FIG. 1, there is a maintenance-and-recovery mechanism 25 which performs maintenance and recovery of liquid recording heads in the carriage 20. Further, a detachable main cartridge 26 is set in the image forming apparatus 1. The main cartridge 26 includes each color of ink which is supplied to a sub tank of the corresponding liquid recording head.

The rolled out rolled medium 10, as shown in FIG. 2, after passing through a rolled medium setting guide 40*a* or 40*b* and a conveyance roller pair 9*a* or 9*b*, further passing through a predetermined conveyance route formed by medium conveyance guide members 31 and 32, etc., and being nipped and conveyed by the registration roller 34 and a pressure roller 35, reaches the image forming unit 3. Further, an image is formed by the liquid recording heads which eject liquid droplets of respective colors onto the rolled medium 10 according to the image data. The rolled medium 10 on which the image is formed is cut to be a predetermined length by a cutter 27 disposed in a discharging unit.

The cutter 27 is fixed to a wire or a timing belt which is rolled around between pulleys (one of the pulleys is connected to a drive motor), and is moved by the drive motor in the main-scanning direction Y, and thus, the rolled medium 10 is cut to be the predetermined length. The cut rolled medium 10 is discharged and stacked in a discharging unit.

Configuration of Rolled Medium Setting Guide

Next, the rolled medium setting guide 40, which is one of characteristic units of the present invention, will be described referring to FIGS. 4-6. It should be noted that the rolled medium setting guide 40*a* corresponding to the upper stage rolled medium 10*a* and the rolled medium setting guide 40*b* corresponding to the lower stage rolled medium 10*b* have the same configuration. Therefore, in the following, suffixes "a" and "b" in the reference numerals may be omitted accordingly.

A first setting guide (contact member) 41 as a guide member is disposed, as shown in FIGS. 4 and 5, near a roll supporting member 12*a* as a fixing member. As shown in FIG. 6, there is a follower koro-roller 42 on the tip of the first setting guide 41. The follower koro-roller 42 always contacts a lower side outer periphery of the rolled medium 10 set in the image forming apparatus 1. In other words, the follower koro-roller 42 follows the remaining amount of the rolled medium 10 and a size of the core tube.

A second setting guide (auxiliary member) 45 as a guide member is disposed, as shown in FIGS. 4 and 5, closer to a roll supporting member 12*b* compared to the first setting guide 41. The setting guide 41 and the setting guide 45 are, as shown in FIG. 5 and FIG. 6, connected at a base via a fulcrum shaft 43 as a rotary shaft, and thus, the second setting guide 45 rotates synchronously with the first setting guide 41.

Setting and Removing the Rolled Medium

Next, setting and removing the rolled medium 10 will be described. The rolled medium 10 is detachable as an operator can set and remove the roll supporting members 12*a* and 12*b* in and from the spool bearing stands 11*a* and 11*b* at the front of the image forming apparatus 10.

When an operator wants to set the rolled medium 10 in the medium supplying apparatus, as shown in FIG. 7, the operator inserts the tip of the rolled medium 10 into the medium supplying apparatus. At this time, the rolled medium 10 may be rotated while being supported by supporting koro-rollers 13 included in the spool bearing stands 11*a* and 11*b*.

Here, as shown in FIG. 7, in the case where a first setting guide 141 (FIG. 8) and a second setting guide 145 (FIG. 11), which rotate in accordance with the outer periphery of the rolled medium 10, are not provided, when the operator inserts the paper tip F into the medium supplying apparatus, the paper will dangle. Therefore, the operator needs to hold the paper by hand to prevent the paper from dangling, and inserts the paper tip F into the medium supplying apparatus. As a result, there is a problem in that workability of setting the rolled medium 10 in the medium supplying apparatus is extremely degraded. It should be noted that the similar problem occurs in the case where the setting guide does not rotate in accordance with the outer periphery of the rolled medium 10 or in the case where the setting guide is short.

The first setting guide 141 and the second setting guide 145 of another present embodiment rotate, as shown in FIG. 8 and FIG. 11, in accordance with the outer periphery of the rolled medium 10. Therefore, the first setting guide 141 and the second setting guide 145 play a role of preventing the paper tip F from dangling by its own weight.

Here, in the present embodiment a position of the roll supporting member 12*b* (FIG. 4) which supports the rolled medium 10 is changed according to the length of the rolled medium 10 in the longitudinal direction. For example, in the case where the end of the rolled medium 10 in the longitudinal direction is near the position where the second setting guide 45 is disposed, if the first setting guide 41 and the second setting guide 45 have a same length in the medium feeding direction, then the second setting guide 45 contacts the roll supporting member 12.

Further, an outer diameter of the rolled medium 10 is changed in accordance with use of the rolled medium 10. For example, even in the case where the end of the rolled medium 10 in the longitudinal direction is near the position where the second setting guide 45 is disposed, when, as shown in FIG. 9, the outer diameter of the rolled medium 10 is greater than the roll supporting member 12, if the first setting guide 41 and the second setting guide 45 have a same length in the medium feeding direction, then the second setting guide 45 contacts the outer periphery of the rolled medium 10. However, when, as shown in FIG. 10, the outer diameter of the rolled medium 10 is less than the roll supporting member 12, the second setting guide 45 contacts the roll supporting member 12.

As described above, if the second setting guide 45 contacts the roll supporting member 12, then there is a problem in that the remaining amount of the rolled medium 10 cannot be properly followed by the second setting guide 45. Further, there is a problem of strange noise occurrence.

The second setting guide 45 according to the present embodiment has a shape in which the length in the medium feeding direction is shorter than the first setting guide 41. Further, the first setting guide 41 and the second setting guide 45 extend in parallel from the fulcrum shaft 43. Further, when the first setting guide 41 is in a state where it contacts the outer periphery of the rolled medium 10, the second setting guide 45 does not contact the outer periphery of the rolled medium 10. Therefore, even when the position of the roll supporting member 12*b* is changed, it is only the first setting guide 41 whose position is in a range where the first setting guide 41 does not directly contact the roll supporting member 12*b*, but that contacts the rolled medium 10 via the follower koro-roller 42. As a result, the first setting guide 41 can follow the remaining amount of the rolled medium 10. Further, the printing quality can be maintained because there is no interference or contact with the paper being conveyed, and thus, there is no conveyance load.

As shown in FIGS. 5 and 6, above the fed rolled medium 10, a third setting guide (second auxiliary member) 46 as a guide member is disposed extending in the longitudinal direction of the rolled medium 10 set in the image forming apparatus 1. The third setting guide 46 includes a third setting guide body 46*a*, a third setting guide tip 46*b*, and a plurality of rib-like connections 46*c* which connect the third setting guide body 46*a* and the third setting guide tip 46*b*.

By further including the third setting guide 46 in addition to the first setting guide 41 and the second setting guide 45, workability of setting the rolled medium 10 is improved.

Further, the third setting guide 46 includes an opening 46*d* among the third setting guide body 46*a*, the third setting guide tip 46*b*, and the connections 46*c*. In other words, the third setting guide 46 includes the opening 46*d* which penetrates from the upper side of the third setting guide to the lower side of the third setting guide 46.

By including the opening 46*d* in the third setting guide 46, visibility is improved and the rolled medium 10 can be easily set in the image forming apparatus 1. Further, because the rolled medium 10 can be pressed when there is curling in the rolled medium 10, it will not be difficult to set the curled rolled medium 10 in the image forming apparatus 1. It should be noted that the third setting guide 46 may be made transparent in order to improve the visibility.

Next, a second embodiment of the present invention will be described in detail referring to the accompanying drawings. It should be noted that a configuration in common with the image forming apparatus according to the first embodiment will be indicated by the same reference numerals and the detailed description will be omitted while a different configuration will be described in detail referring to the drawings.

The second embodiment differs from the first embodiment in that the relative positional relationship between the first setting guide and the second setting guide is different from the first embodiment. Specific descriptions are as follows.

Here, in the first embodiment, the first setting guide 41 contacts the rolled medium 10 and the second setting guide 45 does not contact the rolled medium 10. As a result, there is a problem in that the slightly rolled out tip of the rolled medium 10 may dangle in an area where the first setting guide 41 does not contact the rolled medium 10.

The first setting guide 141 and the second setting guide 145 of the present embodiment rotate around the fulcrum shaft 43, maintaining the same angle between the first setting guide 141 and the second setting guide 145, as shown in FIG. 11. It should be noted that a plurality of the second setting guides 145 may maintain different angles with the first setting guide 141.

Because the first setting guide 141 and the second setting guide 145 rotate around the fulcrum shaft 43, maintaining the same angle between the first setting guide 141 and the second setting guide 145, the tip of the rolled medium 10 in an area where the first setting guide 41 does not contact the rolled medium 10 can be prevented from dangling. As a result, workability of setting the rolled medium 10 is improved. It should be noted that the first setting guide 141 and the second setting guide 145 are not limited to the above embodiment, and that the first setting guide 141 and the second setting guide 145 may move maintaining a fixed distance offset.

Next, a third embodiment of the present invention will be described in detail referring to the accompanying drawings. It should be noted that a configuration common with the image forming apparatus according to the first embodiment will be indicated by the corresponding reference numerals and the detailed description will be omitted while a different configuration will be described in detail referring to the drawings.

The third embodiment differs from the first embodiment in that the configuration of the second setting guide is different. Specific descriptions are as follows.

Here, in order to improve workability of setting the rolled medium, a length of a conventional rolled medium setting guide in the medium feeding direction is provided as long as possible. However, as described above, the position of the roll supporting member 12*b* changes. As a result, if the length of the rolled medium setting guide is always the same, then the rolled medium setting guide may interfere the roll supporting member 12*b*. As a result, there is a problem in that the rolled medium setting guide cannot follow the remaining amount of the rolled medium.

A second setting guide 245 according to the present embodiment includes, as shown in FIG. 12, an extension-and-contraction mechanism. Specifically, the second setting guide 245 includes a second setting guide body 245*a*, a second setting guide tip member 245*b*, and an elastic member 245*c* which elastically changes its form and connects the second setting guide body 245*a* and the second setting guide tip member 245*b*.

By including the extension-and-contraction mechanism in the second setting guide 245, even if the second setting guide 245 interferes the roll supporting member 12, the elastic member 245*c* can absorb a stress due to the interference. Therefore, the second setting guide 245 will not be separated from the rolled medium 10, and it becomes possible to realize the further improvement of the setting workability. It should be noted that it is not limited that only the second setting guide 245 includes the extension-and-contraction mechanism, but the first setting guide and/or the third setting guide may include the extension-and-contraction mechanism.

It should be noted that the present invention is not limited to the configurations described in the above embodiments and configurations combined with other elements, or the like may be adopted. With respect to the embodiments described above, modifications may be possible without departing from the spirit of the present invention and may be defined accordingly depending on applications.

The present application is based on and claims the benefit of priority of Japanese Priority Application No. 2015-002988 filed on Jan. 9, 2015, the entire contents of which are hereby incorporated by reference.

REFERENCE SIGNS LIST

10 Rolled medium
41 First setting guide (an example of a guide member)
43 Fulcrum shaft (an example of a rotary shaft)
45 Second setting guide (an example of a guide member)
46 Third setting guide (an example of a guide member)

CITATION LIST

Patent Literature

[PTL 1] Patent document 1: Japanese Laid-Open Patent Application No. 2000-272794

The invention claimed is:

1. A medium supplying apparatus with a detachable rolled medium configured to be fed to a far side of a setting-and-removing direction of the rolled medium, the medium supplying apparatus comprising:

a plurality of guide members configured to guide the rolled medium when the rolled medium is set, wherein the guide members include at least one contact member configured to at least partially contact only an outer periphery of the rolled medium and at least one auxiliary member configured not to contact the outer periphery of the rolled medium, wherein the contact member and the auxiliary member are connected at a base via a same rotary shaft, the auxiliary member is shorter than the contact member in a medium feeding direction, and the auxiliary member is disposed in parallel with the contact member.

2. The medium supplying apparatus according to claim 1, wherein the guide members include at least one second auxiliary member configured not to contact the rolled medium above the fed rolled medium.

3. The medium supplying apparatus according to claim 2, wherein the second auxiliary member includes an opening penetrating from an upper side to lower side of the second auxiliary member.

4. An image forming apparatus comprising the medium supplying apparatus according to claim 1.

5. A medium supplying apparatus with a detachable rolled medium configured to be fed to a far side of a setting-and-removing direction of the rolled medium, the medium supplying apparatus comprising:

a plurality of guide members configured to guide the rolled medium when the rolled medium is set, wherein the guide members include at least one contact member configured to at least partially contact only an outer periphery of the rolled medium and at least one auxiliary member configured not to contact the outer periphery of the rolled medium, wherein the contact member and the auxiliary member are connected at a base via a same rotary shaft, the auxiliary member is shorter than the contact member in a medium feeding direction, and the auxiliary member is disposed non-parallel with the contact member.

6. The medium supplying apparatus according to claim 5, wherein the auxiliary member is disposed having a predetermined angle with respect to the contact member.

7. The medium supplying apparatus according to claim 5, wherein the guide members include at least one second auxiliary member configured not to contact the rolled medium above the fed rolled medium.

8. The medium supplying apparatus according to claim 7, wherein the second auxiliary member includes an opening penetrating from an upper side to lower side of the second auxiliary member.

9. An image forming apparatus comprising the medium supplying apparatus according to claim 5.

10. A medium supplying apparatus with a detachable rolled medium configured to be fed to a far side of a setting-and-removing direction of the rolled medium, the medium supplying apparatus comprising:

a plurality of guide members configured to guide the rolled medium when the rolled medium is set, wherein the guide members include at least one contact member configured to at least partially contact only an outer periphery of the rolled medium and at least one auxiliary member configured not to contact the outer periphery of the rolled medium, wherein the contact member and the auxiliary member are connected at a base via a same rotary shaft, the auxiliary member includes an extension-and-contraction mechanism capable of extending and contracting.

11. The medium supplying apparatus according to claim 10, wherein the guide members include at least one second auxiliary member configured not to contact the rolled medium above the fed rolled medium.

12. The medium supplying apparatus according to claim 11, wherein the second auxiliary member includes an opening penetrating from an upper side to lower side of the second auxiliary member.

13. An image forming apparatus comprising the medium supplying apparatus according to claim 10.

* * * * *